United States Patent [19]

Dewas

[11] 4,041,991

[45] Aug. 16, 1977

[54] WEAVING MACHINE WITH EXTERNAL WEFT SUPPLY

[75] Inventor: Raymond Dewas, Amiens, France

[73] Assignee: Control Drug, Inc., Port Reading, N.J.

[21] Appl. No.: 698,535

[22] Filed: June 22, 1976

[30] Foreign Application Priority Data

June 24, 1975 Luxembourg ..... 72791
Oct. 13, 1975 Luxembourg ..... 73576

[51] Int. Cl.[2] ..... D03D 47/00
[52] U.S. Cl. ..... 139/449
[58] Field of Search ..... 139/449, 443–446

[56] References Cited

U.S. PATENT DOCUMENTS 2,890,725 6/1959 Brannock ..... 139/449
3,335,760 8/1967 Scheffel ..... 139/449
3,610,294 10/1971 Maassen et al. ..... 139/449
3,888,272 6/1975 Larsson ..... 139/449

FOREIGN PATENT DOCUMENTS 1,407,632 9/1975 United Kingdom ..... 139/449

*Primary Examiner*—James Kee Chi
*Attorney, Agent, or Firm*—Arthur A. Jacobs

[57] ABSTRACT

Weaving machine with weft supplied from spools located outside the shed, has at least one weft inserter actuated by a driving wheel which is driven in a reciprocal movement of rotation, and further includes, for the control of the driving wheel, a toothed belt in cooperating relation with a pulley which is coupled with the driving wheel, and a driving system coupled to the belt in order to impart a reciprocal movement thereto.

8 Claims, 7 Drawing Figures

WEAVING MACHINE WITH EXTERNAL WEFT SUPPLY

This invention relates to weaving machines with weft supplied from spools located outside the shed.

For the insertion of the weft, the machine comprises either a single weft inserter which takes the weft on one side of the shed and transfers it to the other side or two weft inserters, one of which takes the weft on one side of the shed and transfers it to the middle of the shed where it is taken up by the other weft inserter.

In both cases, each inserter is driven in reciprocating motion. The inserter is provided with an actuating tape which is usually flexible and an end needle which is usually rigid for holding the weft. The tape is provided wth perforations which cooperate with the teeth of a driving wheel to which is imparted an alternating movement of rotation under the control of a toothed sector. This toothed sector in turn performs a pivotal movement about its axis under the control of a cam which is keyed on a shaft of the machine.

The assembly which is constituted by the toothed sector and cam entails high capital cost.

Furthermore, by reason of the increase in nominal widths of weaving and/or increasing operating speeds, these mechanical components are subjected to progressively higher stresses and absorb an increasing amount of energy by reason of their inertia, with the result that it is not possible to exceed a given value in respect of the length of weft inserted per unit of time.

The main object of the invention is to overcome these disadvantages by providing a control device for the toothed driving wheel which is of lightweight construction so as to reduce the absorption of energy by inertia but which is nevertheless capable of withstanding higher operating speeds and production rates while being lower in cost price.

In accordance with the invention, the weaving machine comprising at least one weft inserter actuated by a driving wheel which is driven in an alternating movement of rotation is characterized by the fact that is comprises in addition, for the control of the driving wheel, a toothed belt in cooperating relation with a pulley which is coupled with the driving wheel, and a driving system preferably of the crank and crankshaft type which is coupled to said belt in order to impart an alternating movement thereto.

Preferably, said pulley is secured coaxially with the driving wheel.

In accordance with a preferred embodiment of the invention, provision is made of a carriage on which are mounted two guide pulleys and which is actuated by the crank and crankshaft system in a rectilinear reciprocating movement, the belt being so arranged as to extend between two fixed anchoring points and to pass successively over one pulley of the carriage, over a guide pulley having a stationary axis, over the pulley which is coupled to the driving wheel, over a second guide pulley having a fixed axis and over the second pulley of the carriage, the tackle system thus formed being intended to multiply by 2 the travel of the carriage for the belt. The angle of envelopment of the belt on each of the two pulleys of the carriage is 180° and the two pulleys of the carriage and the two pulleys having a fixed axis are aligned in the direction of displacement of the carriage.

In accordance with another characteristic feature of the invention, means are provided for applying additional tension to the belt at least in proximity to at least one of the two reversals of direction of travel of the belt.

A clear understanding of the invention will be gained from a perusal of the following description and by referring to the accompanying drawings, wherein.

Figure 1:
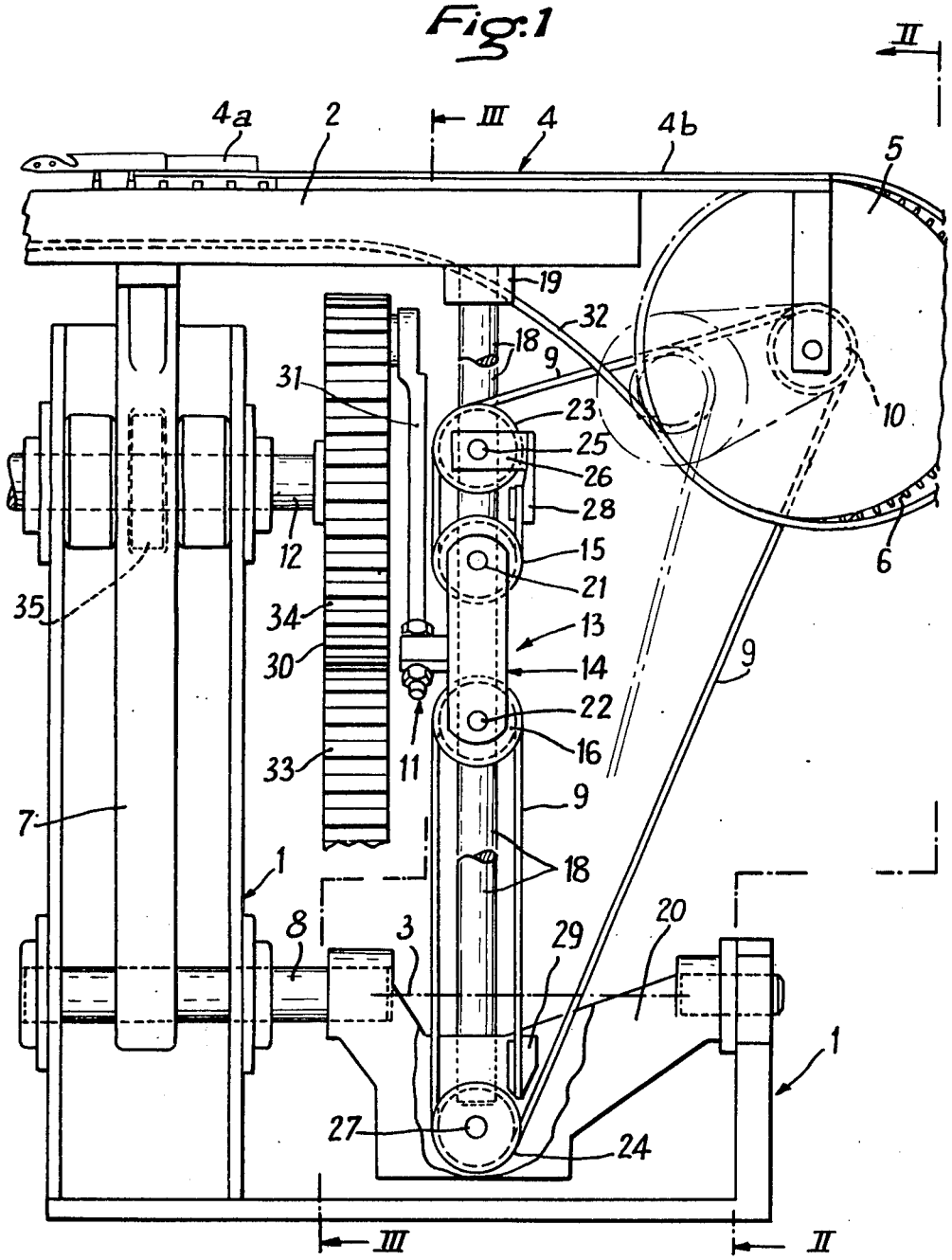
FIG. 1 is a partial front view with portions broken away and showing a weaving machine in accordance with the invention.

The weaving machine comprises in known manner a stationary frame 1, a slay 2 which is driven in an alternating pivotal movement about a lower horizontal axis 3, at least one weft inserter 4 having a head **4*a* which is usually rigid, a tape 4*b* which is usually flexible, and a toothed wheel 5 for driving the weft inserter 4 by means of teeth 6 which cooperate with perforations of the weft inserter. The inserter 4 and the wheel 5 are mounted on the slay 2. This latter is carried at its two lateral extremeties by two arms or swords 7 (only one of which is visible in FIGS. 1 and 3) which are rigidly fixed to a bottom horizontal shaft 8 supported by the frame 1. The slay 2** is driven in its alternating pivotal movement by means of a suitable driving device which will be mentioned below.

In accordance with the invention, in order to impart an alternating movement of rotation to the driving wheel 5, provision is made for a toothed belt 9 in cooperating relation with a pulley 10 which is coupled with the driving wheel 5 and preferably secured coaxially to said wheel 5, and a crank and crankshaft system 11 carried by a shaft 12 which is parallel to the axis 3 of pivotal motion of the slay, said crank and crankshaft system being coupled to the belt 9 in order to impart an alternating movement thereto. The belt 9 thus drives the wheel 5 in an alternating movement of rotation for driving the weft inserter 4.

In accordance with the preferred embodiment of the invention, provision is made of a tackle device 13 comprising a vertically sliding carriage 14 and carrying two freely-mounted pulleys 15 and 16. The carriage 14 comprises two lateral sleeves 17 having a vertical axis and capable of sliding on two vertical columns 18. The columns 18 are secured at their upper extremities to a cross-member 19 which is rigidly fixed to the slay 2 and at their lower extremities to a cradle-shaped support 20 pivotally mounted on the frame 1 about the bottom horizontal axis 3 about which the slay 2 is capable of displacement in pivotal motion. The pulleys 15, 16 are disposed between the columns 18 and are mounted on horizontal axle-pins 21, 22 which are parallel to the common axle-pin of the wheel 5 and of the pulley 10 and located respectively at the top portion and at the bottom portion of the carriage.

Provision is made in the vertical plane of the pulleys 15 and 16 of two guide pulleys 23, 24 having a fixed axis parallel to the axle-pins 21, 22. The upper pulley 23 is also located between the columsn 18 and is idle on a horizontal axle-pin 25 supported by brackets 26 which are clamped on the columns 18. The bottom pulley 24 is in alignment with the pulleys 15, 16 and 23 and is idle on a horizontal axle-pin 27 supported by the cradle 20.

For the purpose of anchoring the belt 9, provision is made of upper jaws 28 carried by the brackets 26 and lower jaws 29 carried by the cradle 20. The belt 9 thus extends from the jaws 28 to the jaws 29 and passes successively over the five pulleys 15, 23, 10, 24 and 16. In order to ensure that no slack is produced in the belt 9 at the time of displacement of the carrige, the jaws 28 and 29 are so arranged that the belt passes round the pulleys 15 and 16 through an angle of 180°.

Figure 3:
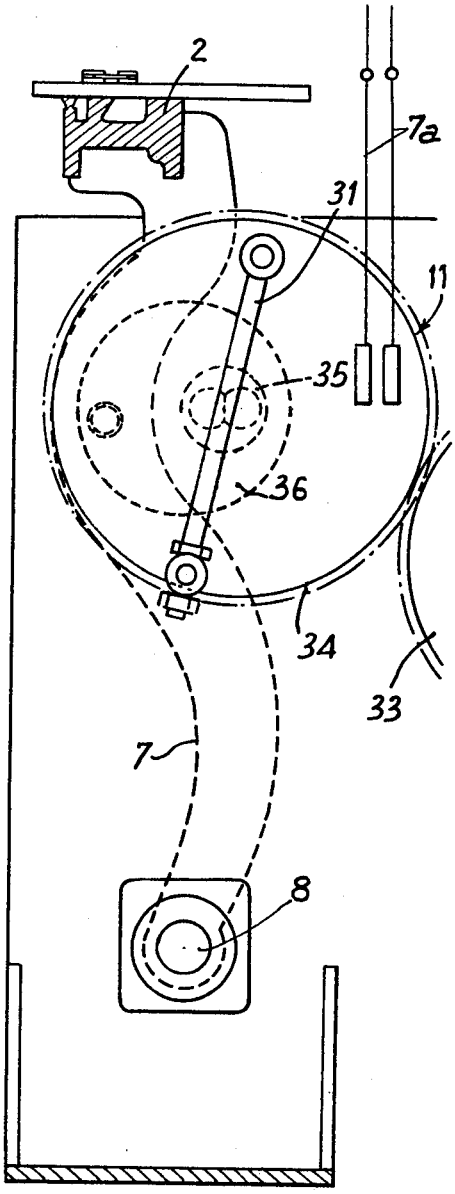
FIG. 3 is a sectional view taken along line III—III of FIG. 1, also partially in phantom lines.

The crank and crankshaft system 11 comprises a crank disk 30 and a crank-arm 31 pivotally mounted on the disk 30 and on the carriage 14. Preferably and in accordance with an advantageous feature, the shaft 12 for supporting and driving the crank and crankshaft system 11 is located as shown in FIG. 3 between the slay swords 7 and the heddles *7a* which cause the warp threads to move substantially in the vertical mid-plane of the columns 18 in order to reduce to a minimum the transverse efforts on the columns 18 and in order to give the carriage a maximum amplitude of motion and a favourable law of motion.

The crank and crankshaft system 11, the tackle system 13 and the ratio between the pulley 10 and the wheel 5 are calculated so as to ensure that the inserter 4 has an alternating motion of the required amplitude.

As shown in FIG. 1, the flexible tape *4b* of the weft inserter can pass round the wheel 5 through an angle of more than 180°. After the wheel 5, said inserter is transferred into a guide 32 which returns it beneath the top portion of the slay between the columns 18 and above the crank disk 30.

The crank disk 30 is driven by any suitable means, for example by a toothed driving wheel 33 which cooperates with teeth 34 of the disk 30.

In order to obtain the length and the position of travel stroke of the weft inserter head *4a*, the crank-arm 31 is mounted on the disk 30 and on the carriage 14 in an adjustable manner.

The slay 2 is driven in its reciprocal pivotal motion about the axis 3 by means of the swords 7 which are each actuated in turn by the shaft 12 by means of a crankshaft 35 and a rod 36 which provides a coupling with the sword. The crank 36 is cylindrical and of circular cross-section and its axis is parallel to the articulation axes and in the plane thereof.

By means of the arrangement in accordance with the invention, the elements which undergo reversals of direction are of lightweight construction, thus resulting in low absorption of energy and the belt readily withstands the operating speeds and production rates imposed by the carriage; furthermore, the device for driving the weft inserter is low in cost and makes it possible to attain a greater length of weft inserted per unit of time.

In the case of weaving machines of considerable width, the tackle device can be duplicated; it is also possible to displace the pulley 10 and to provide an additional pulley which replaces the pulley 10 and is actuated by an endless auxiliary belt extending round these two pulleys as shown in phantom lines in FIG. 1.

During operation, the belt 9 is subjected to a tension which depends especially on the driving force, on the resisting force, on the operating speed and on the inertia forces involved. When the direction of movement of the weft inserter is reversed, the return run of the belt becomes the driving run. In the case of machines which operate in standard widths and/or speeds, the position of reversal of the direction of movement of the inserter is sufficiently precise. However, in the case of machines which operate in large widths and/or at high speeds as is the tendency at the present time, it may be advantageous in accordance with a further feature of the invention to apply additional tension to the belt 9, at least in proximity to one of these reversals in order to ensure that the stopping position of the weft inserter is strictly complied-with in spite of the inertia forces developed.

It would certainly be possible to apply a continuous high tension to the belt 9 but this tension in the first place would give rise in the course of time to degradation of the belt and of the elements with which this latter cooperates, especially the bearings, and in the second place would result in loss of power.

Figure 2:
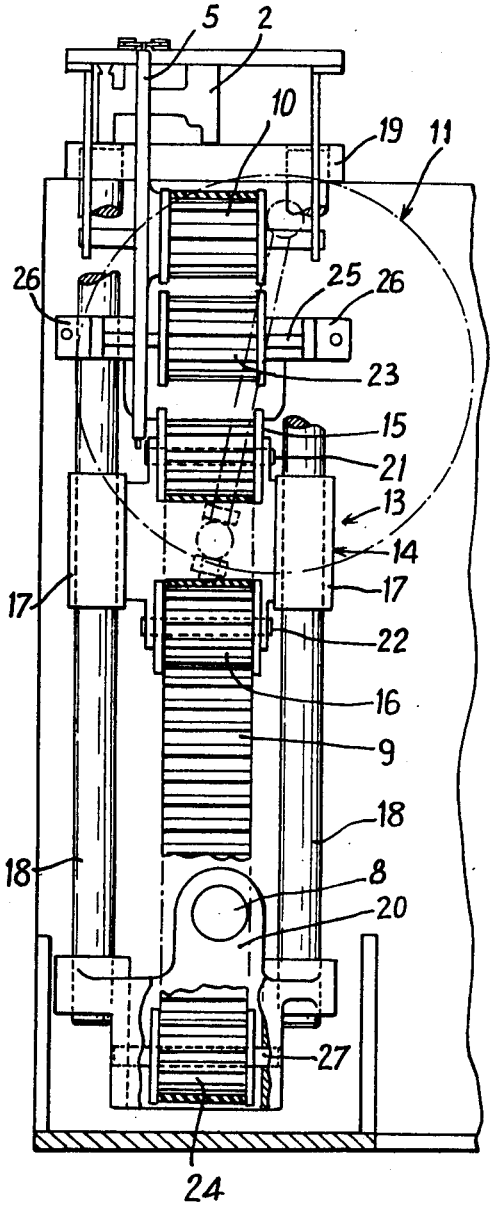
FIG. 2 is a sectional view along the broken line II—II of FIG. 1, also with portions broken away and partially in phantom lines.

The above feature is illustrated diagrammatically in FIGS. 4 to 7 which show part of four machines similar for the remainder to that having been shown in FIGS. 1 to 3. Identical elements are designated by the same reference numerals as in FIGS. 1 to 3.

Figure 4:
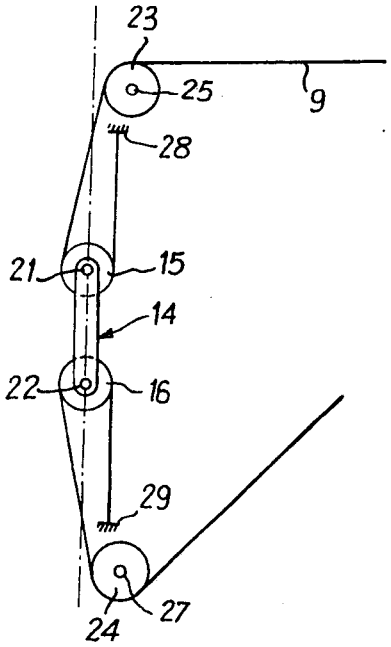
FIG. 4 to 7 are diagrammatic views showing four other embodiments.

In the embodiment shown in FIG. 4, at least one of the axle-pins 25, 27 of the stationary pulleys 23, 24 are slightly displaced or offset towards the wheel 5 in order to ensure that the belt 9 passes round the corresponding pulley 15, 16 through an angle which is greater than 180°. The pulley 24 is displaced in the manner indicated only if it is desired to apply additional tension to the belt only for the end of travel of the weft inserter within the shed.

Figure 5:
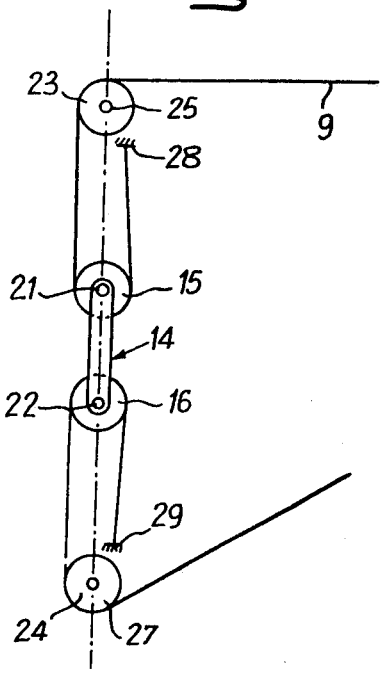

There is shown in FIG. 5 an alternative embodiment in which the axle-pins 25, 27 remain in the plane of the axle-pins 21, 22 and the pairs of jaws 28, 29 (or at least one of these latter) are displaced towards or even beyond said plane in order to obtain an angle of envelopment of the belt 9 on the corresponding pulley 15, 16 which is greater than 180°.

Figure 6:
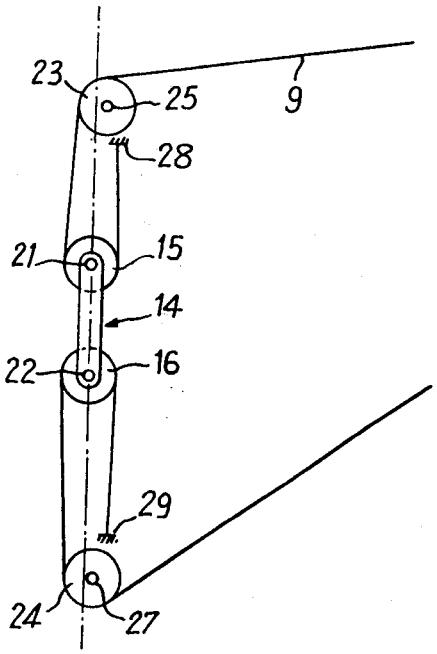

As shown in FIG. 6, it is also possible to combine the arrangements of FIG. 4 and 5 by displacing the two elements 25, 28 and/or 27, 29 in opposite directions at the same time.

Figure 7:
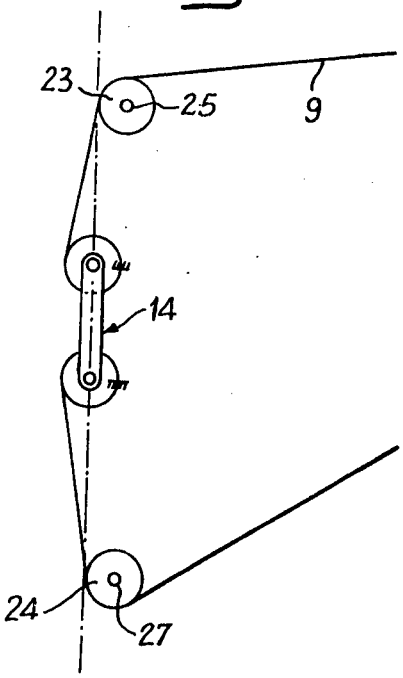

There is shown in FIG. 7 a further alternative embodiment which is applicable to the case in which the machine is not provided with any tackle system. In this case, the belt 9 is directly attached to the carriage 14 and at least one of the axle-pins 25, 27 is moved away from the plane of the axle-pins.

What I claim is:

1. In a weaving machine with weft supplied from spools located outside the shed comprising a stationary frame, an oscillating slay, spaced swords located on opposite sides of said slay, vertical heddles mounted on the stationary frame and serving to move the warp threads, a weft inserter horizontally displaceably mounted on said slay, a driving wheel arranged for imparting movement of said weft inserter, said driving wheel mounted to be reciprocally rotated, a first pulley coupled to said driving wheel for reciprocally rotating said driving wheel, support means attached to said slay, a pair of spaced guiding pulleys secured on said support means, a toothed belt having the opposite ends thereof anchored, said toothed belt between the anchored ends thereof passing over said guiding pulleys and being in driving engagement with said first pulley, a driving means in engagement with said toothed belt for imparting reciprocal movement thereto, wherein the improvement comprises that said driving means includes a belt driving carriage mounted on said support means and reciprocally movable in the substantially vertical direction and arranged in engagement with said toothed belt for transmitting the reciprocal vertical movement thereto, a horizontal shaft extending transversely of the vertical direction of movement of said carriage and having a fixed axis extending parallel to the direction of movement of said weft inserter and said shaft positioned between said swords and said vertical heddles and arranged in cooperation with said swords for imparting oscillatory movement to said slay, a crank disk supported on said shaft, and a crank-arm eccentrically articulated at one point thereon to said crank disk and articulated at another point spaced from said one point of said carriage for moving said carriage in the vertical direction.

2. In a weaving machine, as set forth in claim 1, wherein said toothed belt reciprocates in a vertical plane in engagement with said carriage and moving over said guiding pulleys and said first pulley, said shaft being located in substantially the same vertical plane as the vertical plane of movement of said toothed belt.

3. In a weaving machine, as set forth in claim 1, wherein said support means comprises a pair of laterally spaced vertically extending columns, said carriage being movably mounted on said columns for reciprocal vertical movement thereon.

4. In a weaving machine, as set forth in claim 1, wherein said carriage comprises a pair of vertically spaced and vertically aligned second pulleys, and said toothed belt being trained over said second pulleys.

5. In a weaving machine, as set forth in claim 4, wherein said second pulleys being located between said guiding pulleys, and the axis of said second pulleys and of said guidepulleys being disposed in vertical alignment.

6. In a weaving machine, as set forth in claim 1, comprising means for applying additional tension to said toothed belt at least in proximity to at least one of the points of reversal of direction of travel of said belt.

7. In a weaving machine, as set forth in claim 6, wherein said means for applying additional tension comprises displacing the axis of at least one said guiding pulley laterally out of the vertical path of movement of said carriage in the direction toward said driving wheel for assuring the angle of envelopment of the toothed belt around the adjacent said second pulley on said carriage is greater than 180°.

8. In a weaving machine, as set forth in claim 6, wherein at least one of the anchored ends of said toothed belt is positioned relative to the adjacent said second pulley on said carriage so that the angle of envelopment of said belt on the adjacent said second pulley is greater than 180°.

* * * * *

UNITED STATES PATENT OFFICE

CERTIFICATE OF CORRECTION

Patent No. 4,041,991 Dated August 16, 1977

Inventor(s) Raymond Dewas

It is certified that error appears in the above-identified patent and that said Letters Patent are hereby corrected as shown below:

-- In the heading of the patent [73] Assignee should be omitted.--

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*